US008011541B2

(12) United States Patent
Mikesell et al.

(10) Patent No.: US 8,011,541 B2
(45) Date of Patent: Sep. 6, 2011

(54) TOOL CONTAINMENT SYSTEM

(75) Inventors: Kenneth W. Mikesell, Arvada, CO (US); Michael J. Bible, Fort Collins, CO (US)

(73) Assignee: Castle Mountain Enterprises LLC, Arvada, CO (US)

( * ) Notice: Subject to any disclaimer, the term of this patent is extended or adjusted under 35 U.S.C. 154(b) by 1070 days.

(21) Appl. No.: 11/414,603

(22) Filed: Apr. 28, 2006

(65) Prior Publication Data

US 2007/0114141 A1 May 24, 2007

Related U.S. Application Data

(60) Provisional application No. 60/738,479, filed on Nov. 21, 2005.

(51) Int. Cl.
*A45F 5/00* (2006.01)
*A45F 3/14* (2006.01)
*A45C 13/30* (2006.01)

(52) U.S. Cl. ..... 224/250; 224/904

(58) Field of Classification Search ..... 224/250, 224/149, 150, 904; 206/207; 473/205; 294/25, 294/150

See application file for complete search history.

(56) References Cited

U.S. PATENT DOCUMENTS

| | | | | | |
|---|---|---|---|---|---|
| 3,178,724 | A | * | 4/1965 | Perschke | 2/16 |
| 3,815,908 | A | * | 6/1974 | Hashimoto | 473/62 |
| 4,277,063 | A | * | 7/1981 | Perrone et al. | 473/538 |
| 4,556,215 | A | * | 12/1985 | Tarbox et al. | 482/105 |
| 5,557,805 | A | * | 9/1996 | Emerson | 2/158 |
| 5,810,525 | A | * | 9/1998 | Ector, Sr. | 408/241 R |
| 5,941,434 | A | * | 8/1999 | Green | 224/250 |
| 5,957,515 | A | * | 9/1999 | Van Der Sluys | 294/25 |
| 6,019,404 | A | * | 2/2000 | Pasquale | 294/1.1 |
| 6,098,558 | A | * | 8/2000 | Baird | 112/475.08 |
| 6,729,480 | B1 | * | 5/2004 | Blake | 211/70.6 |
| 6,940,033 | B1 | * | 9/2005 | Jones et al. | 200/522 |

OTHER PUBLICATIONS

U.S. Appl. No. 60/738,479, Mikesell, et al.

* cited by examiner

*Primary Examiner* — Justin M Larson
*Assistant Examiner* — Adam Waggenspack
(74) *Attorney, Agent, or Firm* — Craig R. Miles; CR Miles, P.C.

(57) ABSTRACT

A tool containment system provides various configurations of a flexible member each of which can engage a part of the external surface of a tool to provide connection means for a tether to limit travel of the tool, or to oppose disassembly of tool components, or both.

3 Claims, 19 Drawing Sheets

TOOL CONTAINMENT SYSTEM

This United States Patent Application claims the benefit of U.S. Provisional Patent Application No. 60/738,479, filed Nov. 21, 2005, hereby incorporated by reference herein.

I. BACKGROUND

A tool containment system provides various configurations of a flexible member each of which can engage a part of the external surface of a tool to provide connection means for a tether to limit travel of the tool, or to oppose disassembly of tool components, or both.

There exists a large commercial market for tools that can aid a person in accomplishing a task. Manufacturers have met the demand in that commercial market with a wide variety of hand tools which over time have evolved into power tools using motors powered by conventional line current or by rechargeable battery supplies which can uncouple from the various tools for recharging. While power tools may be convenient to use, especially cordless power tools using rechargeable battery supplies, there remain substantial unresolved problems in the use of such power tools.

A significant problem with the use of portable power tools can be the lack of a fastening means to which a tether can be connected. Portability of power tools, especially cordless power tools, which may have no means by which a tether can be fastened can be a hazard to persons and property when they drop, fall, or are otherwise urged to travel. This can be particularly true of power tools having rechargeable battery supplies where both the tool and the battery supply have sufficient mass to cause injury to persons or property upon impact. Additionally, when the tool becomes uncoupled from the battery supply, both the tool, which presents a hollow interior, and the battery supply, which typically presents projection which mates with the hollow interior of the tool, can be the source of additional injury to persons or generate additional property damage. Moreover, when the tool becomes separated from the battery supply both the tool and the battery supply can become more susceptible to damage. While cordless power tools have been available for many years, it appears that tool manufactures have not yet addressed the problem of limiting the travel of the tool or the uncoupled battery supply.

Another problem with the increased portability of power tools can be the lack of means to retain replacement parts such as drill bits, saw blades, screwdriver bits, or the like proximate to the tool. Similarly, there can be a lack of means to retain certain hardware proximate to the tool, such as screws, nails, rivets, staples, or the like

II. SUMMARY OF THE INVENTION

Accordingly, a broad object of the invention can be to provide a flexible member which engages a part of the external surface of a tool to provide an attachment location for a tether which can reduce travel of the tool when it drops, falls, or may otherwise be urged to travel.

A second broad object of the invention can be to provide a flexible member which engages a part of the external surface of the tool and a part of the external surface of the battery supply to reduce occurrence of the battery supply uncoupling from the tool or to limit travel of the battery supply relative to the tool.

A third broad object of the invention can be to provide a pocket element joined to the flexible member which defines a pocket space in which replacement parts such as drill bits, screwdriver bits, saw blades or the like can be located.

A fourth broad object of the invention can be to provide a object retention surface on which certain expendable objects can be retained for use such as screws, nails, staples, or the like.

A fifth broad object of the invention can be to provide an illumination source which can be made responsive to a portable power tool.

Naturally, further objects of the invention are disclosed throughout other areas of the specification, drawings, or claims.

III. A BRIEF DESCRIPTION OF THE DRAWINGS

IV. DETAILED DESCRIPTION OF THE PREFERRED EMBODIMENTS

A tool containment system provides various configurations of a flexible member each of which can engage a part of the external surface of a tool to provide connection means for a tether to limit travel of the tool, or to oppose disassembly of tool components, or both.

Figure 1:
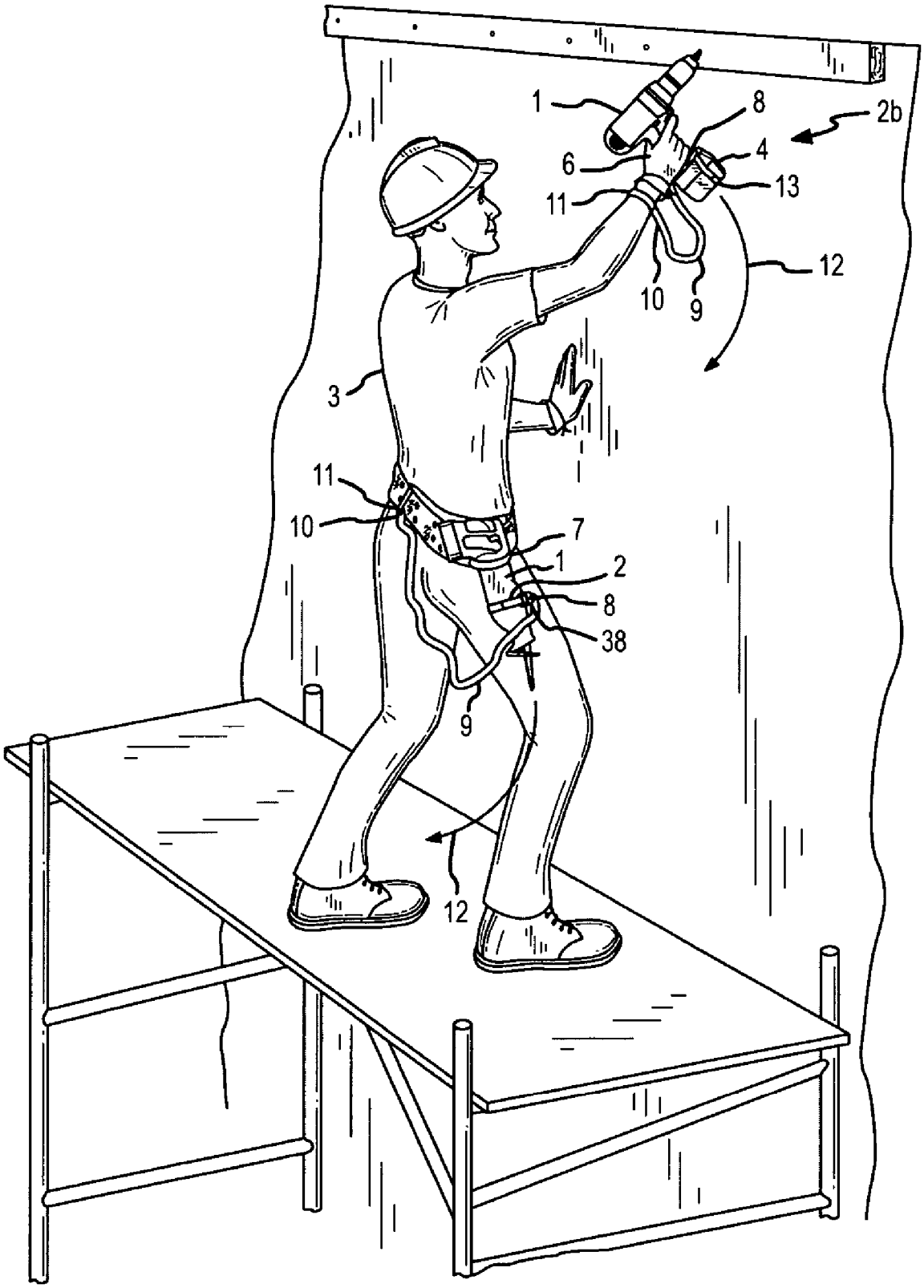
FIG. 1 shows a method of using a particular embodiment of the tool containment invention.

Now referring primarily to FIG. 1, a particular method of using the tool containment system includes the steps of providing a flexible member (13) which can operate between a planar condition (2*a*)(including the non-limiting examples of the flexible member (13) shown in FIGS. 3, 6, 8, 9, 12,14, 16, 18, 19, 23, and 25) and a conformed condition (2*b*)(including the non-limiting examples shown in FIGS. 1, 2, 4, 5, 7, 10, 11, 13, 15, 20, 21, and 22). By engaging a part of the external surface of a tool (1) with a part of a first flexible member surface (5) of the flexible member (13) in the planar condition (2*a*) the step of conforming the flexible member (13) to annularly engage a part of the external surface of the tool (1) can be performed to achieve the conformed condition (2*b*) of the flexible member (13). By generating sufficiently forcible annular engagement between the first flexible member surface (5) of the flexible member (13) and the part of the external surface of the tool (1) a substantially fixed location of the flexible member (13) about the tool (1) can be achieved. Mating parts of a releasable securement element (21) coupled to the flexible member (13) can maintain the sufficiently forcible annular engagement between the first flexible member surface (5) of the flexible member (13) and the part of the external surface of the tool (1) to maintain the flexible member (13) at the substantially fixed location on the part of the external surface of the tool (1) to provide connection means for a tether (9). As to certain embodiments of the flexible member (13), the planar condition (2*a*) can provide configurations that when annularly engaged to a part of the external surface of a tool (1) in the conformed configuration (2*b*) oppose disassembly of the tool components.

By further coupling a first tether end (8) of a tether (9) to the flexible member (13) which in conformed condition (2*b*) annularly engages a part of the external surface of the tool (1) and by coupling a second tether end (10) to a terminal restraint element (11) responsive to the person (3) or other object, a limited range of travel (12) can be established for the tool (1) during handling or operation, if dropped from a person's hand (6) or becomes disengaged from a tool restraint (7), or if the tool (1) is otherwise forcibly urged to travel or falls under the influence of gravity. By limiting the distance the tool (1) can travel or fall, or by generating a tool travel path (12) which is limited or can be anticipated by the person (3) or other persons, the less likely the tool (1) will cause injury to the person (3) or other person(s) or cause damage to the tool (1) itself or other property. While FIG. 1 shows a particular constructional form of a flexible member (13) which can operate between the planar condition (2*a*) and the conformed condition (2*b*) with or without the particular embodiment of the tether (9) shown, the invention is not so limited, and FIG. 1 along with the above-description provided is intended to provide sufficient description from which the person of ordinary skill can use the numerous and wide variety of constructional forms of the invention, whether shown by the Figures or the description (or both) provided herein, or as permutations or combinations of the elements of construction forms of the invention herein shown or described or equivalents thereof.

The term "tool" as used herein is intended to broadly encompass the numerous and varied devices that a person (3) can utilize in accomplishing a task, whether a hand operated device or coupled to a power source (4) such as such as 110 VAC, a battery element, or pressurized gas for pneumatic devices and includes without limitation saws, drills, sanders, nail guns, or the like, and while FIG. 1 shows a construction worker using a hand held drill having a battery as a power source (4), the term "tool" is not intended to be limited by the occupation of the person (3) or to the particular tools (1) shown by the Figures or described herein. Rather, FIG. 1 along with the additional figures and description is intended to enable a person of ordinary skill to utilize the numerous and varied embodiments of the invention along with equivalents thereof with a numerous and wide variety of devices.

The term "containment or containing" as used herein broadly encompasses engagement of a flexible member surface (5) of a flexible member (13), whether in whole or in part, with the external surface of a tool (1), whether in whole or in part, and specifically includes engagement of a part of the flexible member surface (5) with the external surface of the tool (1) such that the flexible member (2) in the conformed condition (2*b*) opposes disassembly of the components of the tool (1) such as disassembly of the battery element (4) (or similar power source) from the remaining portion of the tool (1) or otherwise limits the distance that the component of the tool (1) such as the battery (4) can travel if disassembled (or becomes disengaged or uncouples) from the remaining portion of the tool (1).

The term "planar condition" as used herein means disposed to provide a generally flat surface which may include surface elements having an amount of depth depending upon the type of material laid flat such as weave, stitching, pucker, wrinkles, or the like and specifically includes the flat condition of flexible sheet materials such as cloth, fabric, GORTEX, rubber, plastic, elastomers, or the like.

The term "annularly" is intended to broadly encompass configurations of a flexible member (13) which encircle a part of the external surface of an object or device regardless of the path taken by the flexible member (13) to encircle the part of the external surface of the object or device or the manner of closing the encirclement whether by securement or overlap (or other closure means) of parts or portions of the flexible member (13).

Now generally referring to FIGS. 2-25, various examples of a flexible member (13) are shown each of which can operate between a planar condition (2*a*) and a conformed condition (2*b*) by engaging a part of a first flexible member surface (5) with a part of the external surface of a tool (1).

Figure 2:
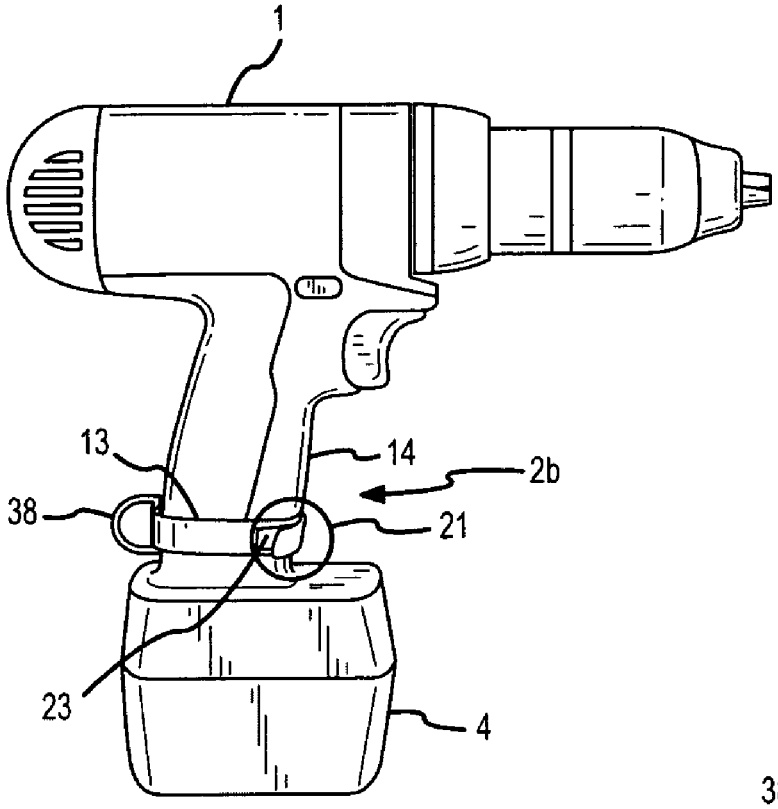
FIG. 2 is a side view of a particular embodiment of the tool containment invention which provides a flexible member which in the conformed condition engages a part of the external surface of a tool.
Figure 3:
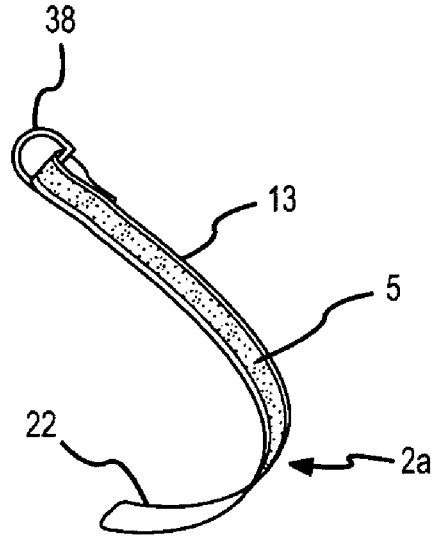
FIG. 3 is a perspective view of the particular embodiment of the tool containment invention shown in FIG. 2 in the planar condition.
Figure 4:
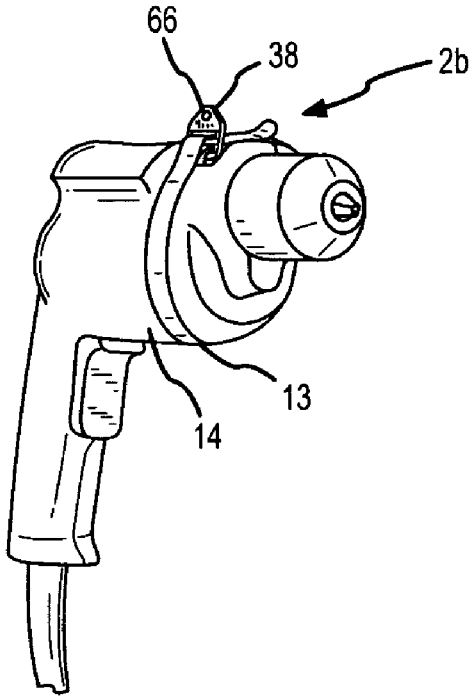
FIG. 4 is a perspective view of a particular embodiment of a tool containment invention which provides a flexible member which in the conformed condition engages a part of the external surface of a tool.
Figure 5:
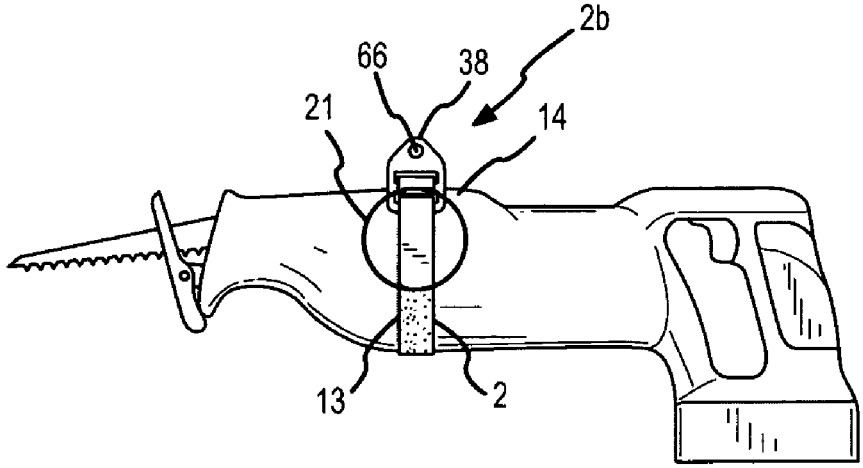
FIG. 5 is a side view of the particular embodiment of a tool containment invention shown in FIG. 4 which provides a flexible member which in the conformed condition engages a part of the external surface of a tool.
Figure 6:
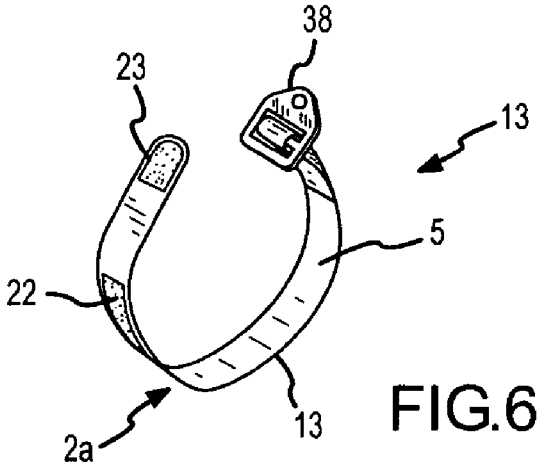
FIG. 6 is a perspective view of the particular embodiment of the tool containment invention shown in FIG. 4 in the planar condition.

As shown in FIGS. 2-3, certain embodiments of the flexible member (13) can be configured to annularly engage a part of the first flexible member surface (5) with a part of the external surface of a particular tool (1), such as the handle (14) of a particular drill, as shown by FIG. 2. Or for example, as shown in FIGS. 4-6, certain embodiments of the flexible member (13) can be configured to annularly engage a part of the first flexible member surface (5) with a part of the external surface of a plurality of different tools (1), such as the tool body (14) of a drill or a saw, or other similarly configured tool body (14).

Figure 7:
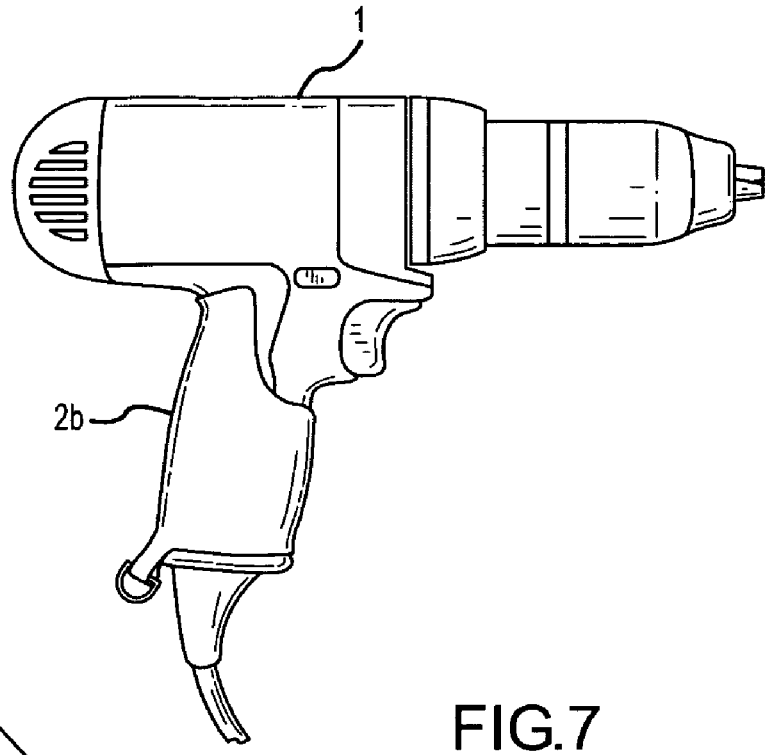
FIG. 7 is a side view of a particular embodiment of the tool containment invention which provides a flexible member which in the conformed condition engages a part of the external surface of a tool.
Figure 8:
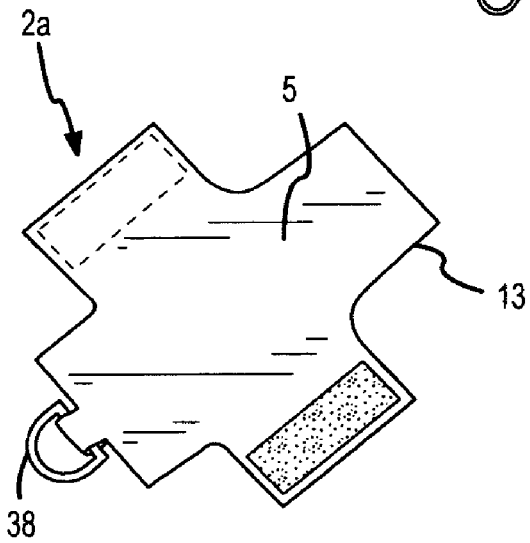
FIG. 8 is a perspective view of the particular embodiment of the tool containment invention shown in FIG. 7 in the planar condition.
Figure 9:
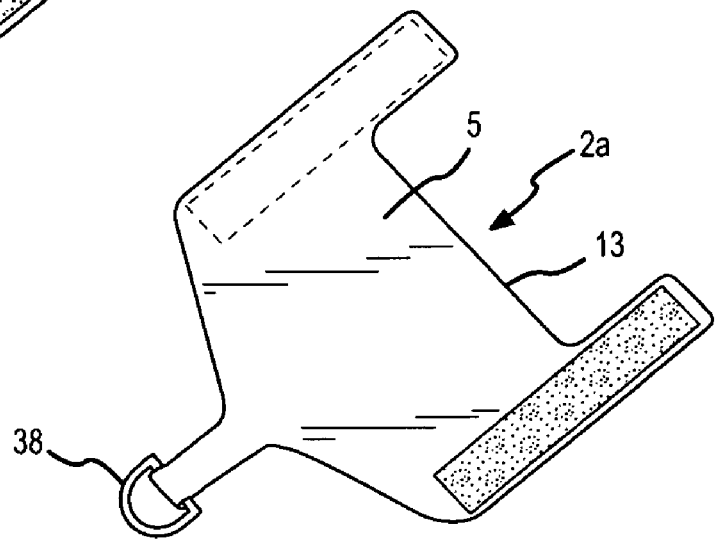
FIG. 9 is a perspective view of another particular embodiment of the tool containment invention shown in FIG. 7 in the planar condition.

As shown by FIGS. 7-9, certain embodiments of the flexible member (13) can provide a first flexible member surface (5) which annularly engages a greater part of the external surface of tool (1) then the embodiments of the invention shown by FIGS. 2-6. While the figures show particular configurations of the flexible member (13), it is not intended that the figures limit the flexible member (13) configuration to any particular measure, volume, or surface area. Rather, the figures are intended to be illustrative of the numerous and varied configurations of the flexible member (13) which can be utilized to provide a first flexible member surface (5) which can annularly engage a part of an external surface of a tool (1). Moreover, the flexible member (13) can be generated using a wide and numerous variety of materials including without limitation: plastics such as nylon, polyethylene, polypropylene, or the like; elastomers such as rubber, synthetic rubber, or the like; materials woven from plastic fibers, elastomer fibers, flexible fibers, natural fibers, or the like, or combinations or permutations thereof; each of which can be used to generate embodiments of the flexible member (13) having a sufficient flexibility to provide first flexible member surface (5) which can be established in the planar condition (2*a*) and which can annularly engage a part of the external surface of a tool (1) in the conformed condition (2*b*).

Figure 10:
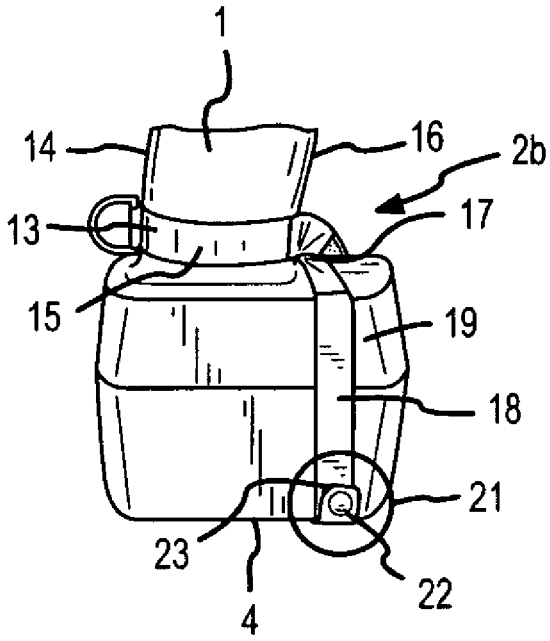
FIG. 10 is a side view of a particular embodiment of the tool containment invention which provides a flexible member which in the conformed condition engages a part of the external surface of a tool.
Figure 11:
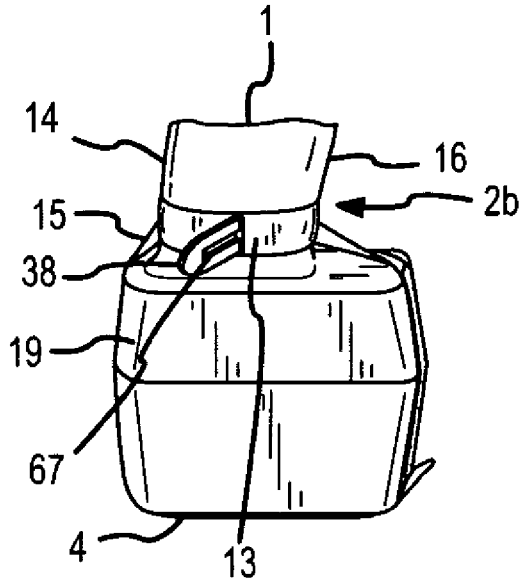
FIG. 11 is an end view of the particular embodiment of the tool containment invention shown in FIG. 10 showing an alternate embodiment of a tether securement element.
Figure 12:
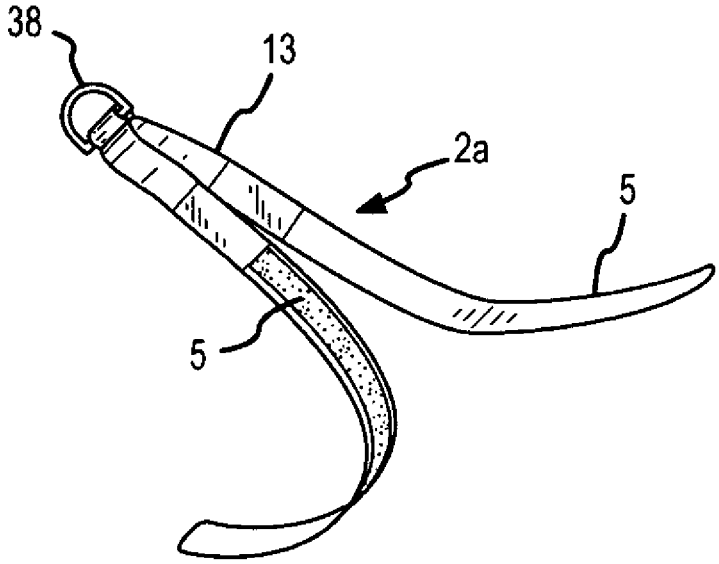
FIG. 12 is a perspective view of a particular embodiment of the tool containment invention similar to that shown in FIGS. 10 and 11 in the planar condition.
Figure 13:
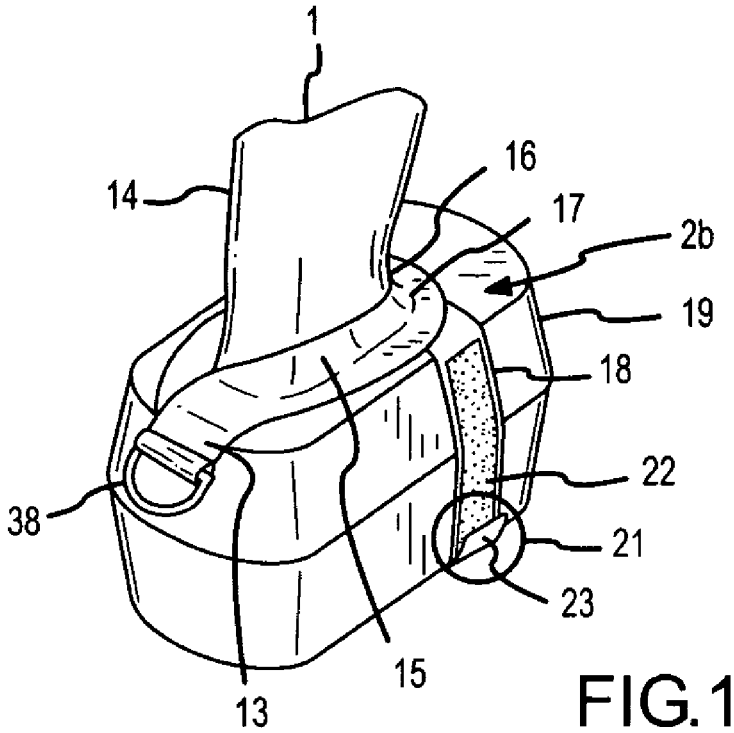
FIG. 13 is an end perspective view of a particular embodiment of the tool containment invention which provides a flexible member which in the conformed condition engages a part of the external surface of a tool.
Figure 14:
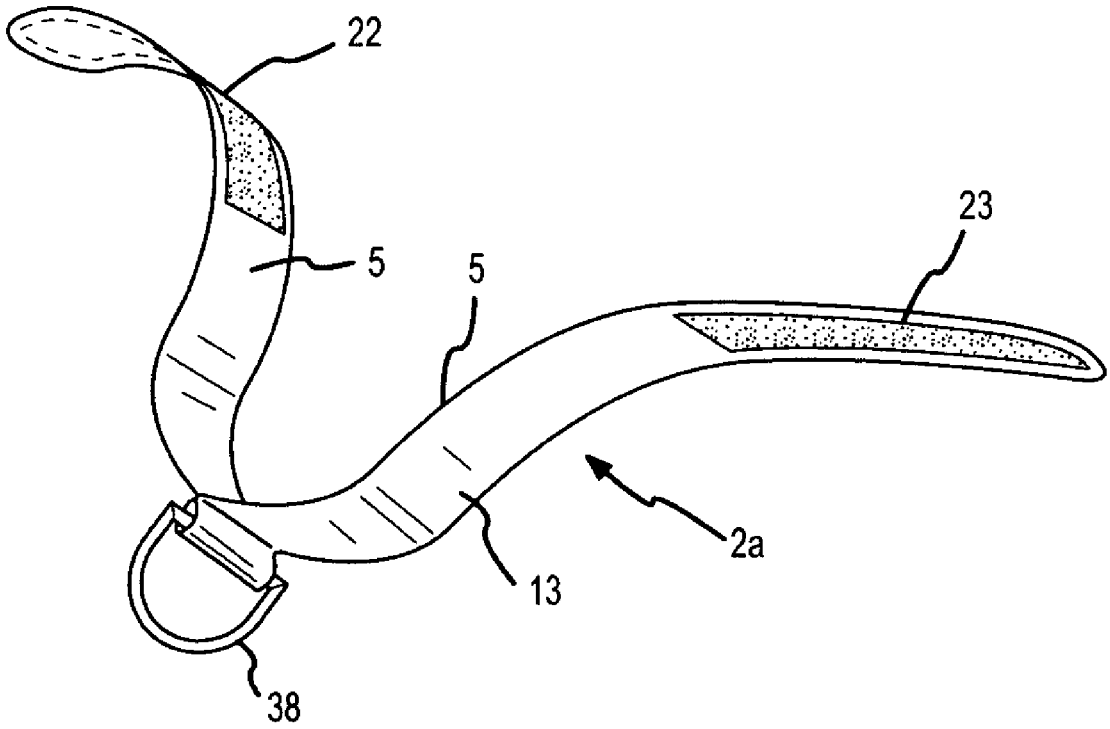
FIG. 14 is a perspective view of a particular embodiment of the tool containment invention shown in FIG. 13 in the planar condition.
Figure 15:
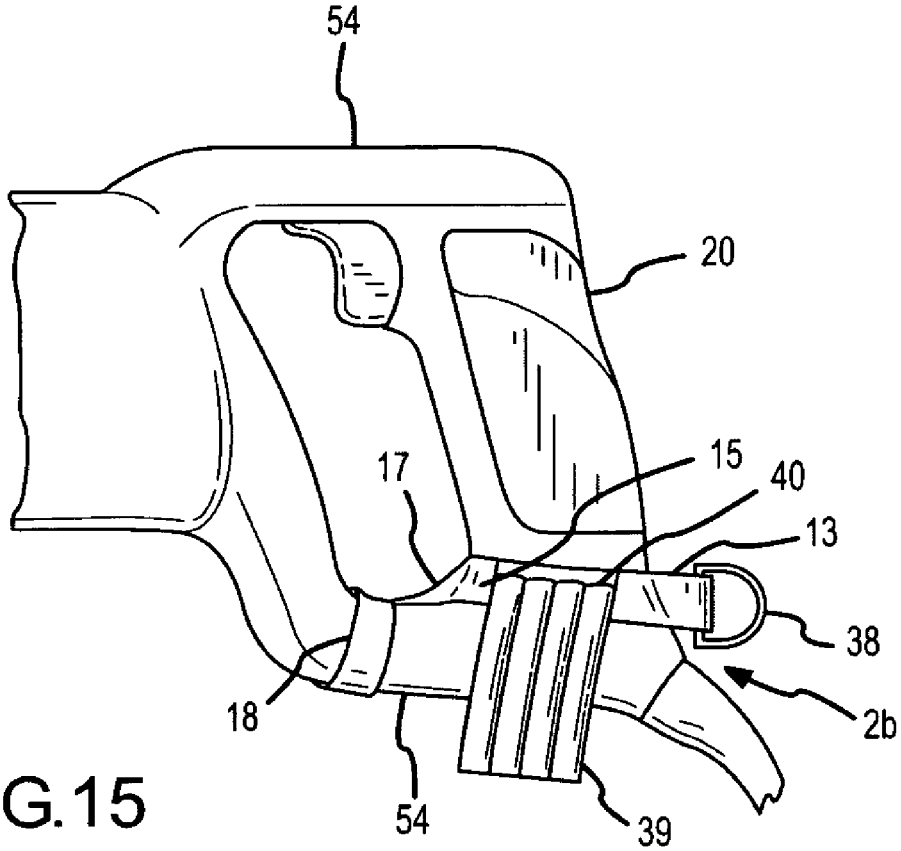
FIG. 15 is side view of a particular embodiment of the tool containment invention which provides a flexible member which in the conformed condition engages a part of the external surface of a tool.
Figure 16:
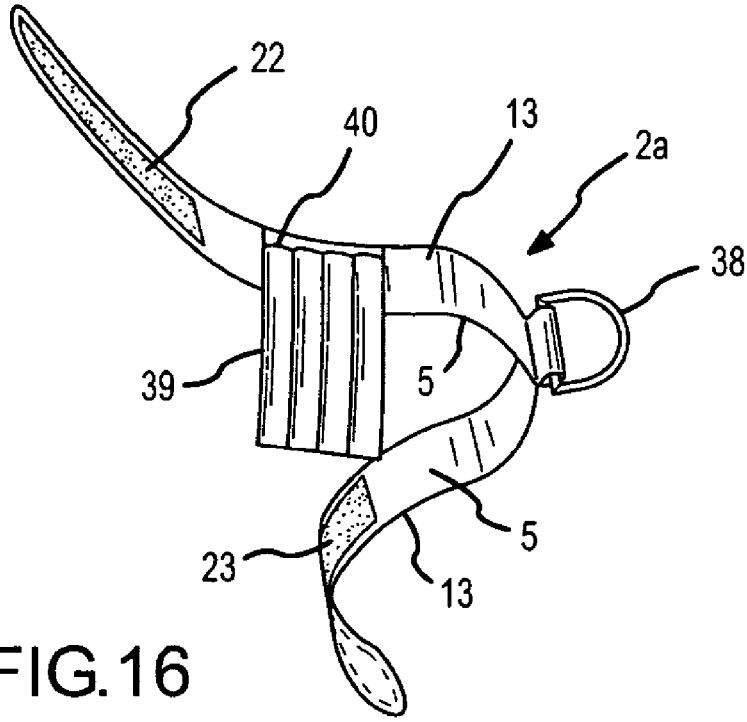
FIG. 16 is a perspective view of a particular embodiment of the tool containment invention shown in FIG. 15 in the planar condition.

As further shown by FIGS. 10-16, certain embodiments of the flexible member (13) which can be established in the planar condition (2*a*) can in the conformed condition (2*b*) establish a first annular engagement (15) about a first part of the external surface (16) of a tool (1)(such as the handle (14) of a tool (1) as shown by FIGS. 10, 11 and 13) and can be further conformed to generate a crossover element (17) such that a second annular engagement (18) about a second part of the external surface (19) of the tool (1) can be established (such as a second annular engagement (18) about the battery element (4) of the tool (1) as shown by FIGS. 10, 11 and 13). Also, as shown by FIGS. 15 and 16, the first annular engagement (15) the crossover element (17) and the second annular engagement (18) can be established on external surface of other tools such as a handle (20) of a saw (the handle (20) shown is often referred to as a D handle as further described below).

Now referring primarily to FIGS. 1-31, embodiments of the invention can further include a securement element (21) coupled to the flexible member (13) comprised of releasably securable mated parts (22)(23) which operate to maintain engagement of a part of the first flexible member surface (5) with a part of the external surface of the tool (1), as above described. While the particular embodiments of the invention shown by FIGS. 2-6 and 10-11 provide a securement element (21) having releasably securable mated parts (22)(23) of hook and loop (such as VELCRO® hook and loop) and while the particular embodiments of the invention shown by FIGS. 7-9 provide a securement element (21) having the releasably securable mated parts (22)(23) of a snap, it is not intended that these examples be limiting with regard to the numerous and varied securement elements (21) or fasteners having releasably secureable mated parts (22)(23) which can be used to maintain engagement of a part of the first flexible member surface (5) with a part of the external surface of the tool (1), such as opposed adhesive surfaces, catches, buckles, or the like.

Figure 18:
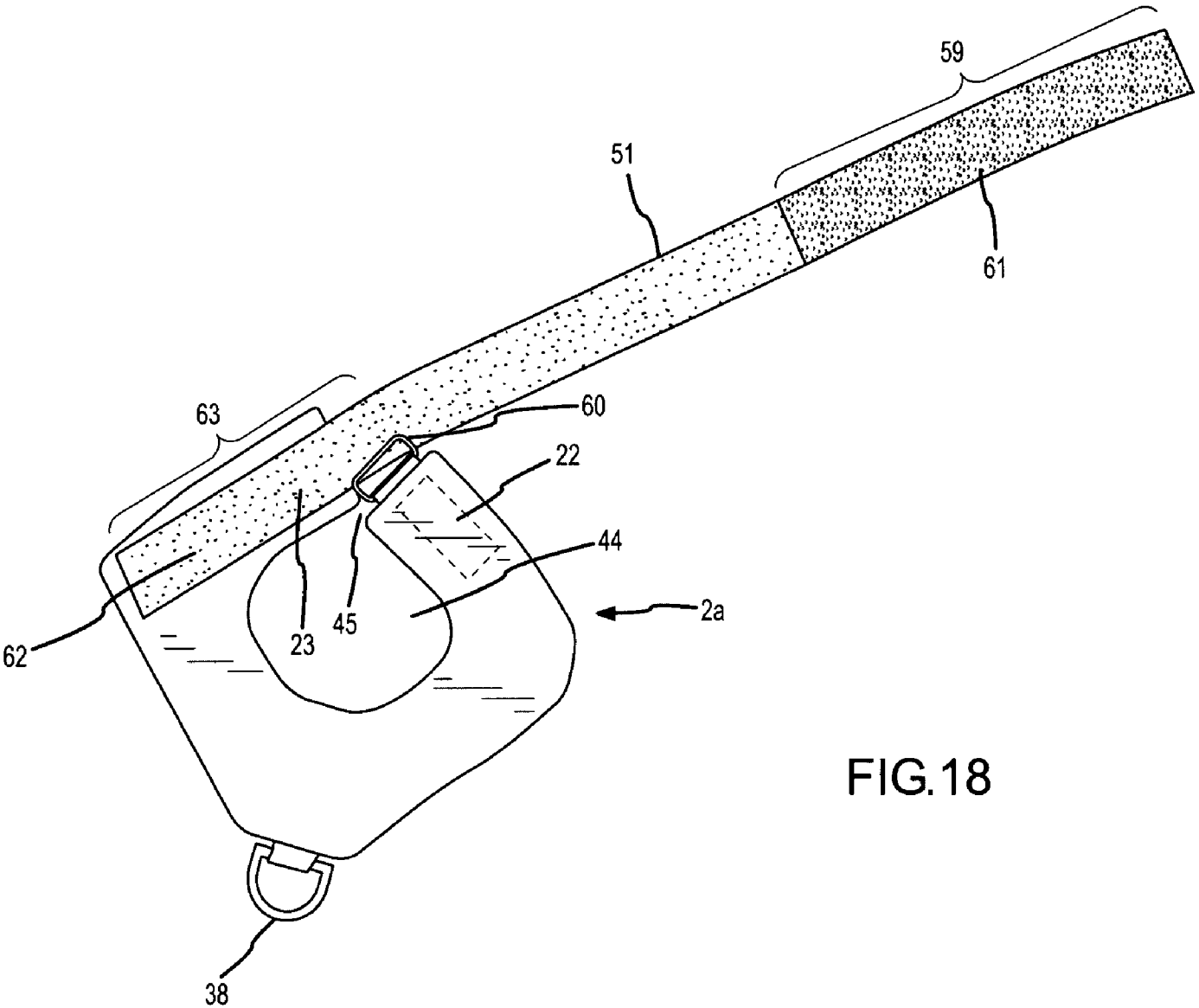
FIG. 18 is a plan view of a particular embodiment of the tool containment invention in the planar condition.
Figure 19:
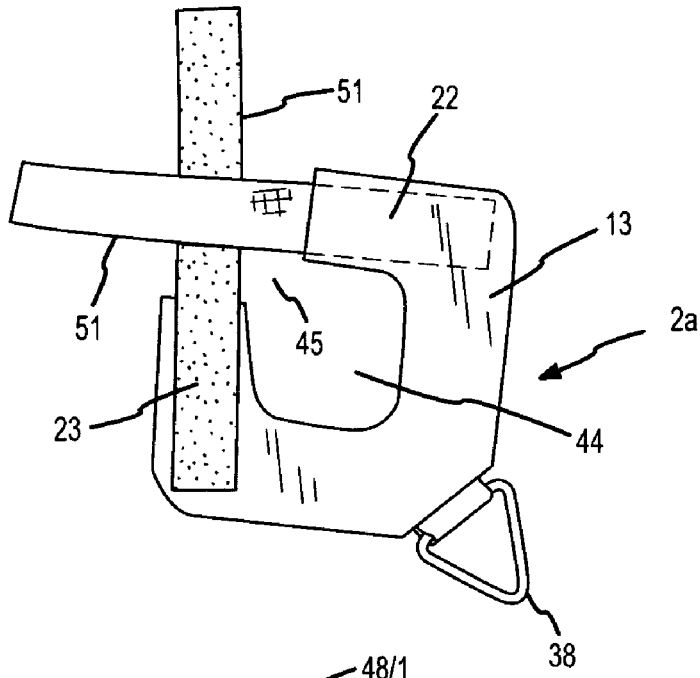
FIG. 19 is a plan view of a particular embodiment of the tool containment invention in the planar condition.
Figure 20:
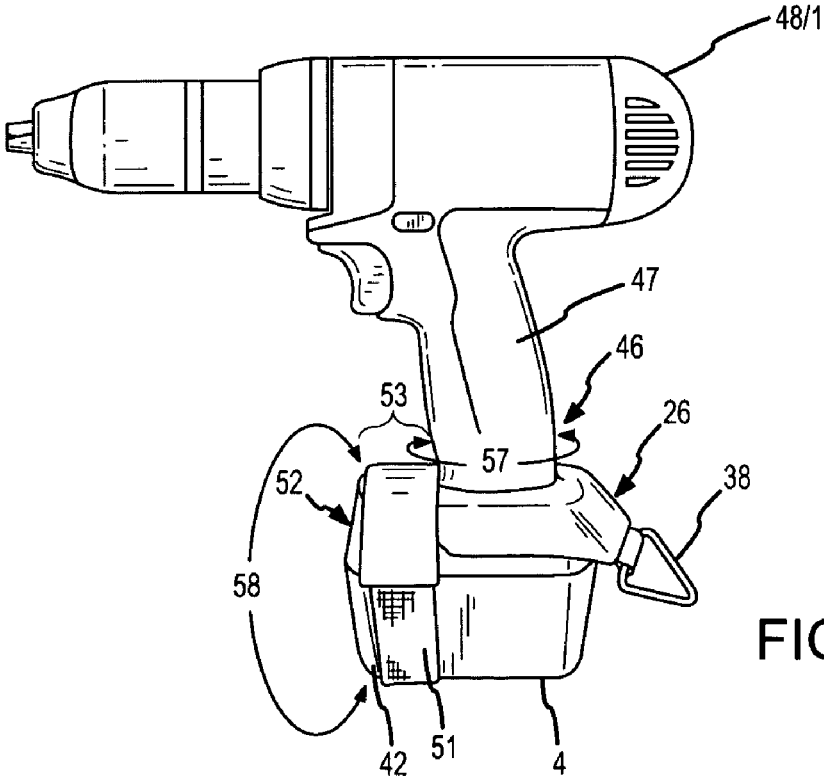
FIG. 20 is a side view of a particular embodiment of the tool containment invention similar to that shown in FIGS. 17, 18, or 19 in the conformed condition to engage a part of the external surface of a tool.
Figure 21:
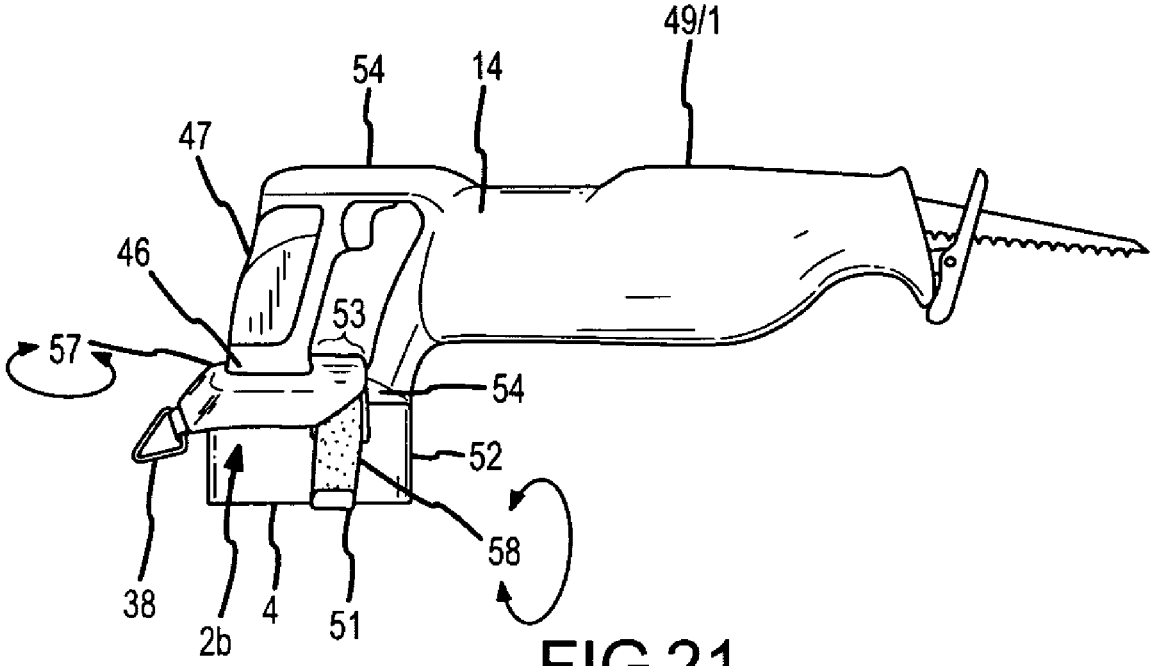
FIG. 21 is a side view of a particular embodiment of the tool containment invention similar to that shown in FIGS. 17, 18, or 19 in the conformed condition to engage a part of the external surface of a tool.
Figure 22:
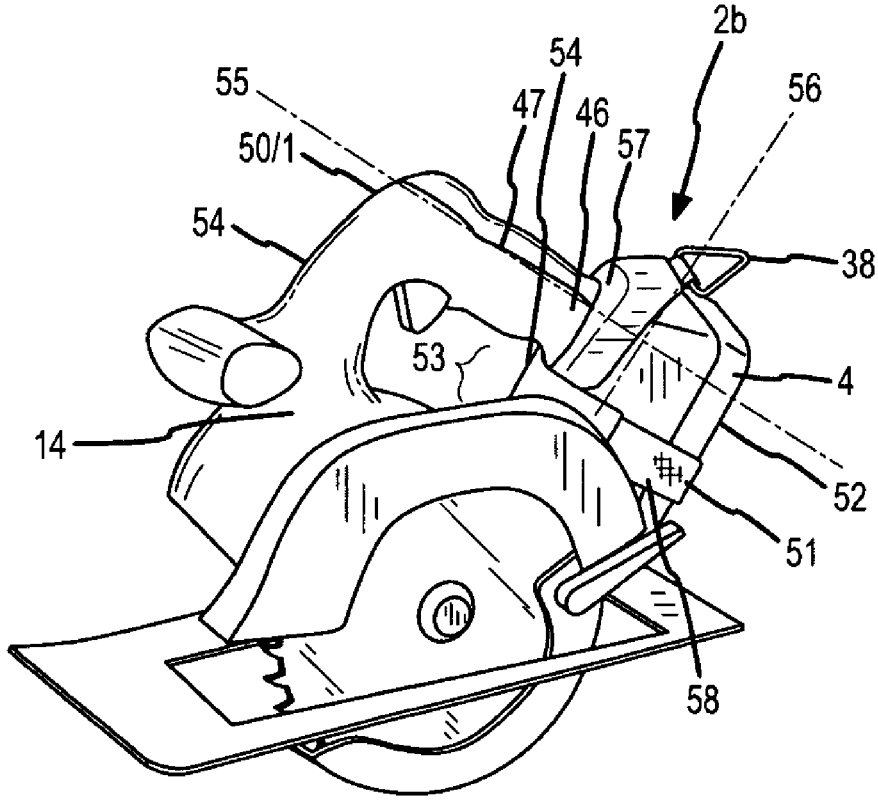
FIG. 22 is a perspective view of a particular embodiment of the tool containment invention similar to that shown in FIGS. 17, 18, or 19 in the conformed condition to engage a part of the external surface of a tool.

Now referring primarily to FIGS. 17-23, particular embodiments of the invention can comprise a flexible member (13) capable of operating between the planar condition (2*a*) as shown in FIGS. 17-19 and 23 and the conformed condition (2*b*) as shown by FIGS. 20-22. The flexible member (13) in the planar condition (2*a*) can further include an aperture element (44) having an open perimeter (45) which can be releasably closed by operation of a first pair of releasably securable mated parts (22)(23) of the securement element (21)(such as VELCRO® hook (22)(shown in hash marks) and loop (23) in the embodiments shown in FIGS. 17-19 and 23). As shown by FIGS. 20-22, the external surface of a first tool part (46) (such as the tool handle (47) of a drill (48) as shown in FIG. 20; the tool handle (47) of the reciprocal saw (49) as shown in FIG. 21; or the tool handle (47) of the circular saw (50) as shown by FIG. 22, or similar first tool parts) can be established within the aperture element (44) of the flexible member (13) in the planar condition (2*a*). The first pair of releasably secured mated parts (22)(23) can be secured to close the open perimeter (45) of the flexible member (13) to generate a first annular engagement (57) of the flexible member (13) in the planar condition (2*a*) with the external surface of the first tool part (46).

Figure 17:
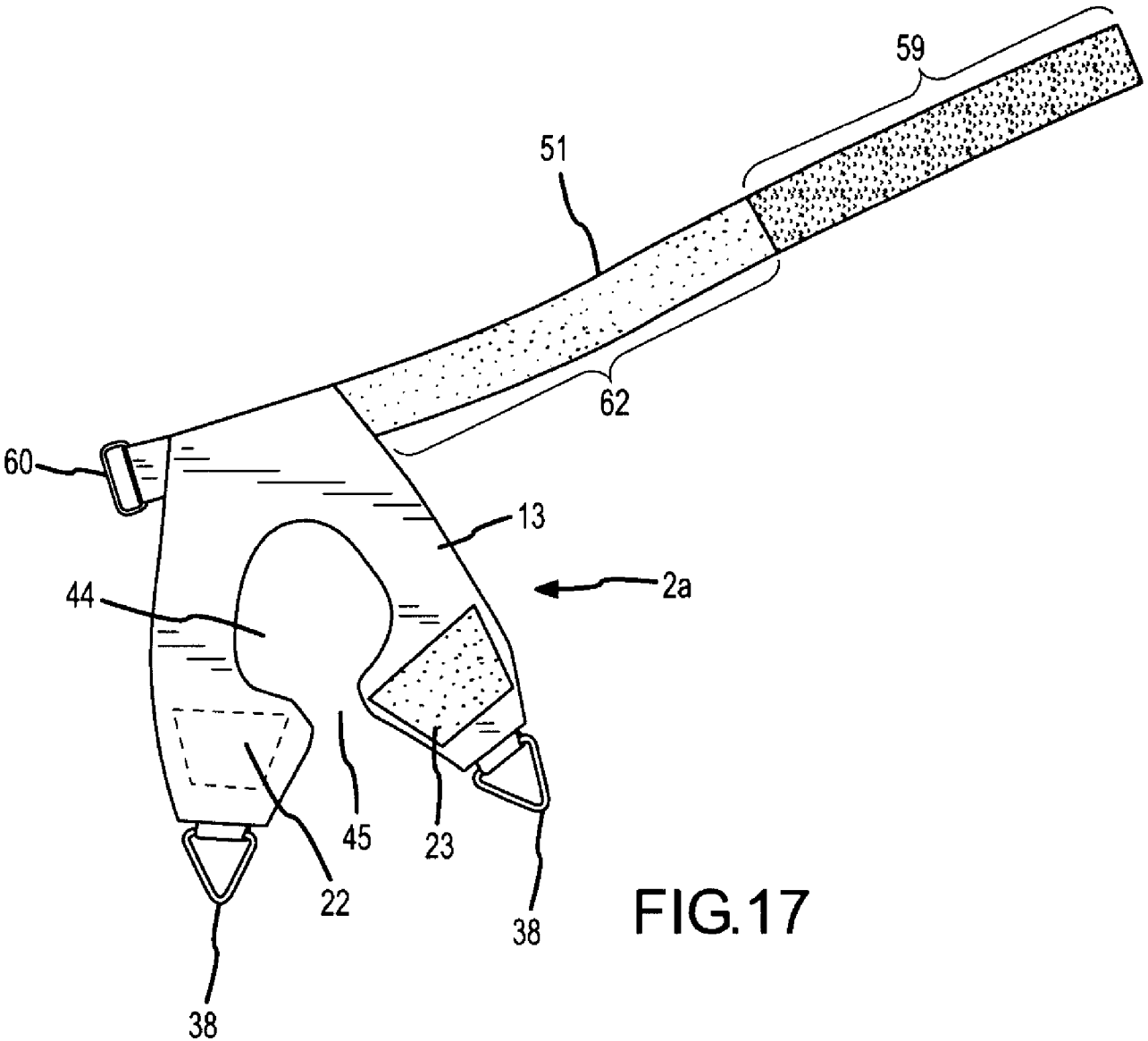
FIG. 17 is a plan view of a particular embodiment of the tool containment invention in the planar condition.

Now referring primarily to FIGS. 17 and 18, the flexible member (13) in the planar condition (2*a*) can further include at least one elongate flexible member (51) which upon closure of the open perimeter (45) can be established at a location relative to a part of the external surface of the tool (1) which allows a second annular engagement (58) of the flexible member (13) with the external surface of a second tool part (52) to be achieved with the at least one elongate flexible member (51).

For example, as shown in FIGS. 20-22, the second tool part (52) can extend a distance (53) from the first tool part (46)(the longitudinal axis of the second tool part (55) extending a distance generally perpendicularly outward from the longitudinal axis (56) of the first tool part (46) as shown in FIG. 22, for example) about which the flexible member (13) has been conformed to achieve the first annular engagement (57) to provide the external surface of the second tool part (52) about which the at least one elongate flexible member (51) can be conformed to establish the second annular engagement (58). Specifically, as shown in FIG. 20, the external surface of the second tool part (52) which extends a distance (53) from the first tool part (46) about which the elongate flexible member (51) annularly engages (58) can be part of the external surface of a battery element (4).

A second and third example are shown respectively in FIGS. 21 and 22, the external surface of the second tool part (52) which extends a distance (53) from the first tool part (46) about which the elongate flexible member (51) can be conformed to achieve the second annularly engagement (58) can be a part of the external surface of one of a pair of extension elements (54) of the tool handle (47) which couple to the tool body (14) of the tool (1)(typically referred to as a D handle).

Again referring primarily to FIGS. 17 and 18, the flexible member (13) including the at least one elongate flexible member (51) can further include a second pair of releasably securable mated parts (59)(60). As shown by FIGS. 17 and 18, the second pair of releasably securable mated parts (59)(60) can include a first terminal portion (59) of the flexible elongate member (51) which can be drawn through a ring element (60) a distance to substantially fix the location of the second annular engagement (58) about the external surface of the second tool part (52). The terminal portion (59) of the flexible elongate member (51) can further provide a hook material (61) which can be releasably secured to a loop material (62)(such as VELCRO® loop material) coupled to second terminal portion (63) of the elongate flexible member (51).

Figure 23:
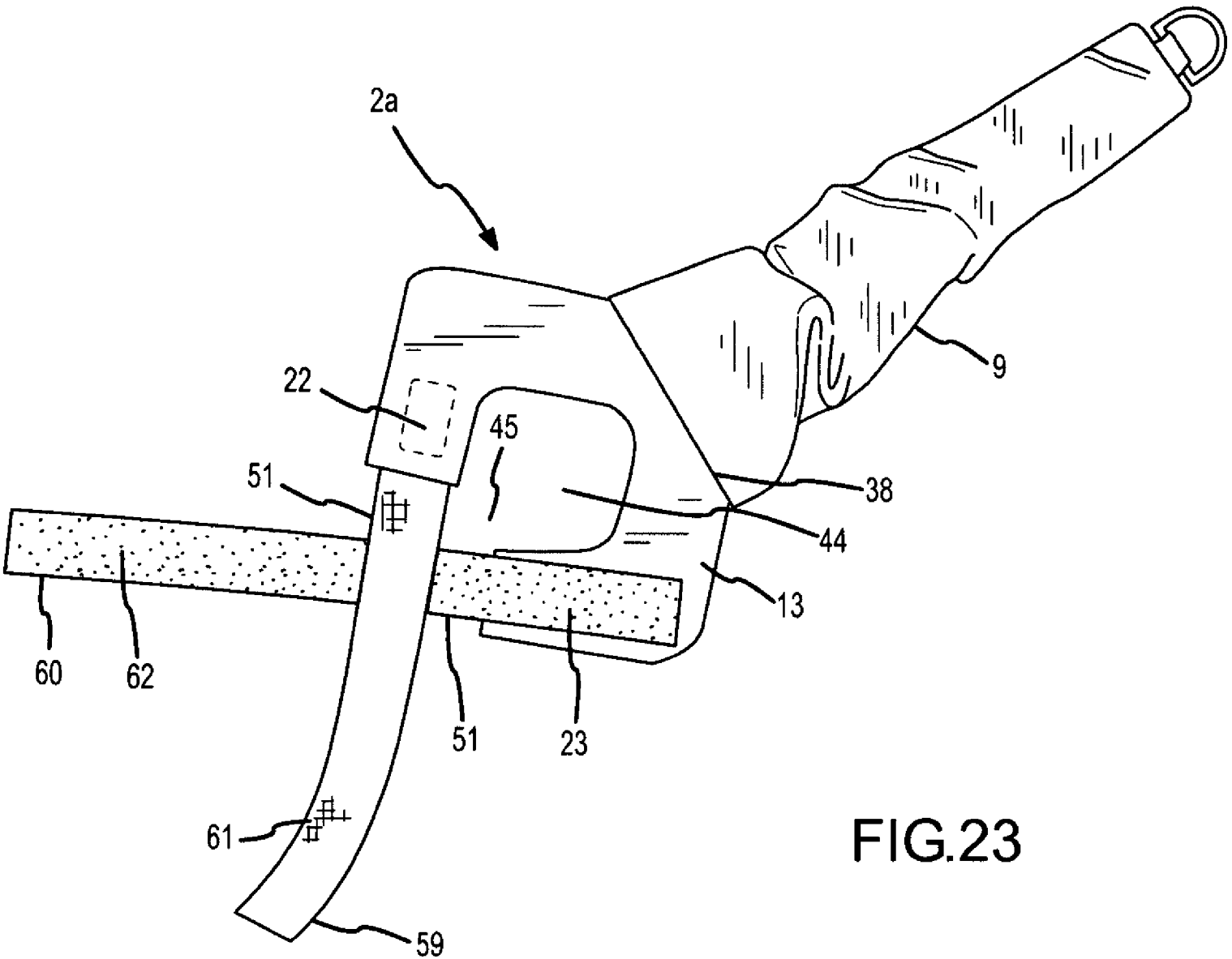
FIG. 23 is a plan view of a particular embodiment of the tool containment invention in the planar condition further including a tether.

Now referring primarily to FIGS. 19 and 23, another embodiment of the flexible member (13) can provide the aperture element (44) having an open perimeter (45) in the planar condition (2*a*) and which can further provide a pair of elongate flexible members (51) which upon closure of the open perimeter (45) by operation of the pair of releasably securable mated parts (22)(23) can each be established at a location relative to the external surface of the tool (1) which allows the second annular engagement (58) of the flexible member (13) to be established with the external surface of a second tool part (52) by opposed directional annular engagement of each one of the pair of elongate flexible members (51) about the external surface of the second tool part (52). A hook material (61) can be coupled to the surface of the first one of the pair of elongate flexible members (51) and a loop material (62) can be coupled to the surface of the second one of the pair of elongate flexible members (51). The hook material (61) and the loop material (62) can by overlapping engagement provide the second pair of releasably securable mated parts (59)(60) to substantially fix the location of the second annular engagement (58) about the external surface of the second tool part (52).

Figure 24:
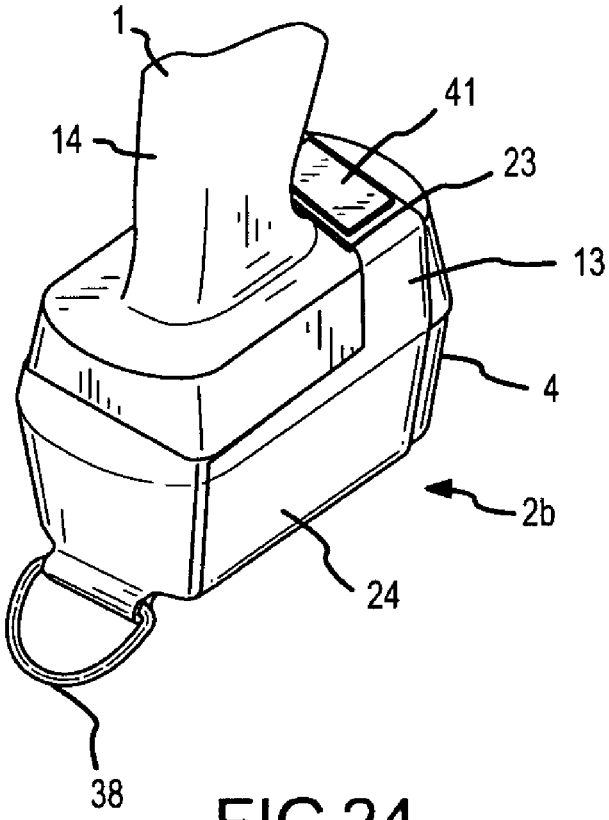
FIG. 24 is an end perspective view of a particular embodiment of the tool containment invention which in the conformed condition engages a part of the external surface of a tool.
Figure 25:
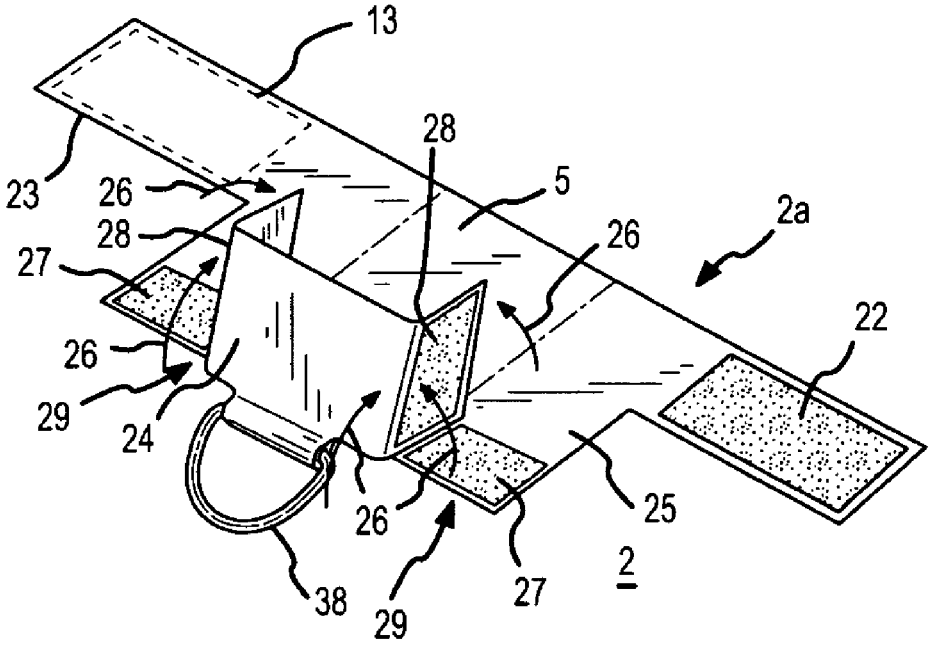
FIG. 25 is a perspective view of a particular embodiment of a tool containment invention shown in FIG. 24 in the planar condition.

Now referring to primarily to FIGS. 24 and 25, the flexible member (13) can be configured to provide a planar condition (2*a*) having a first flexible member surface (5) which can be conformed to a part of the external surface of the power source (4) of the tool (1), such as the battery element shown in FIGS. 2, 10, 11, 13, and 24. As to certain embodiments of invention as shown by FIGS. 24 and 25, a boot (24) can be operably configured (26) from a substantially planar sheet of material (25) by joining releasably securable mated boot parts (27)(28) of a pair of boot fasteners (29). The boot fasteners (29) can comprise one or more of the embodiments of the securement elements (21) above-described or can be a hook material which mates with a loop material (such as VELCRO® hook and loop materials) as shown by FIG. 25.

Figure 26:
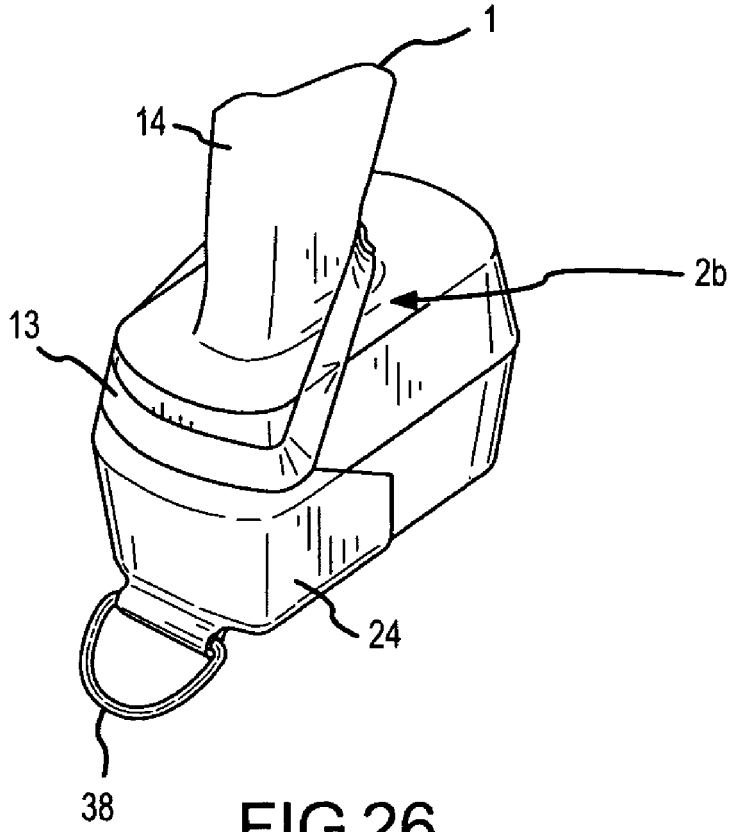
FIG. 26 is an end perspective view of a particular embodiment of the tool containment invention which in the conformed condition engages a boot to a part of the external surface of a tool.
Figure 27:
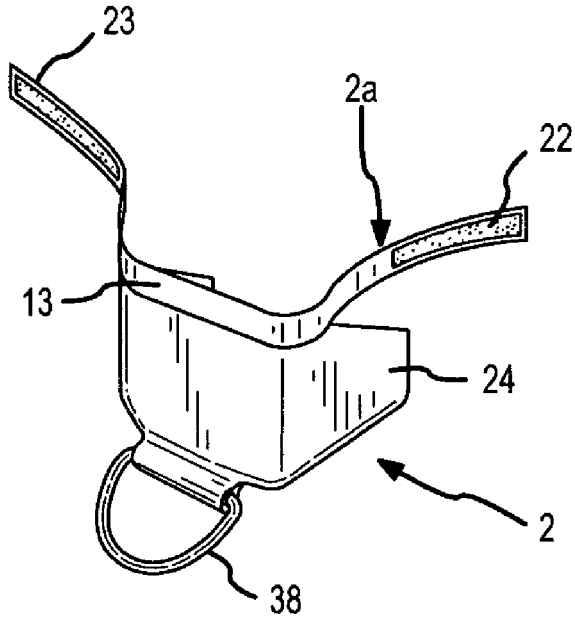
FIG. 27 is a perspective view of a particular embodiment of a tool containment invention shown in FIG. 26 disengaged from the external surface of a tool.
Figure 28:
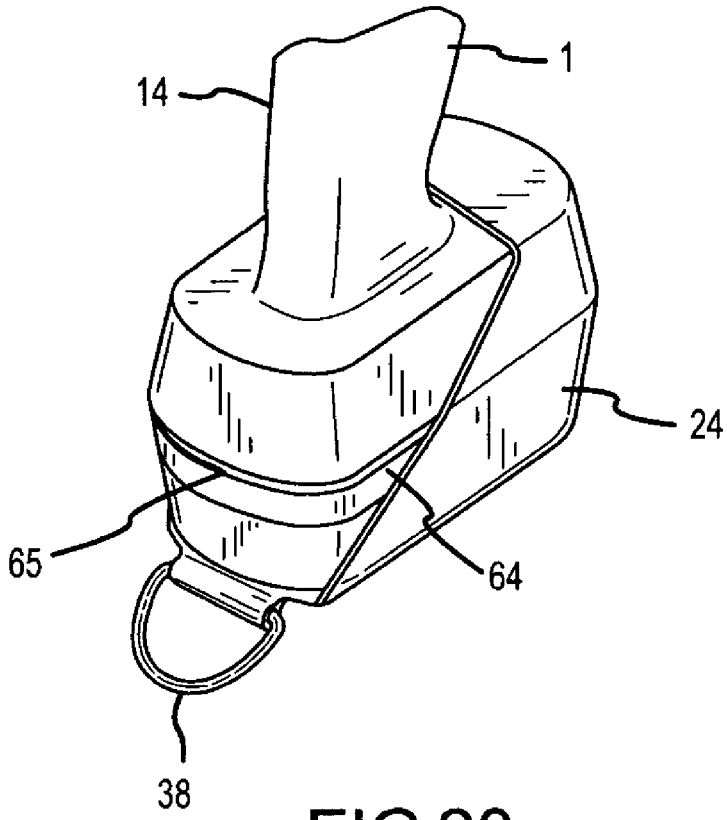
FIG. 28 is an end perspective view of a particular embodiment of the tool containment invention which in the conformed condition engages a boot to a part of the external surface of a tool.
Figure 29:
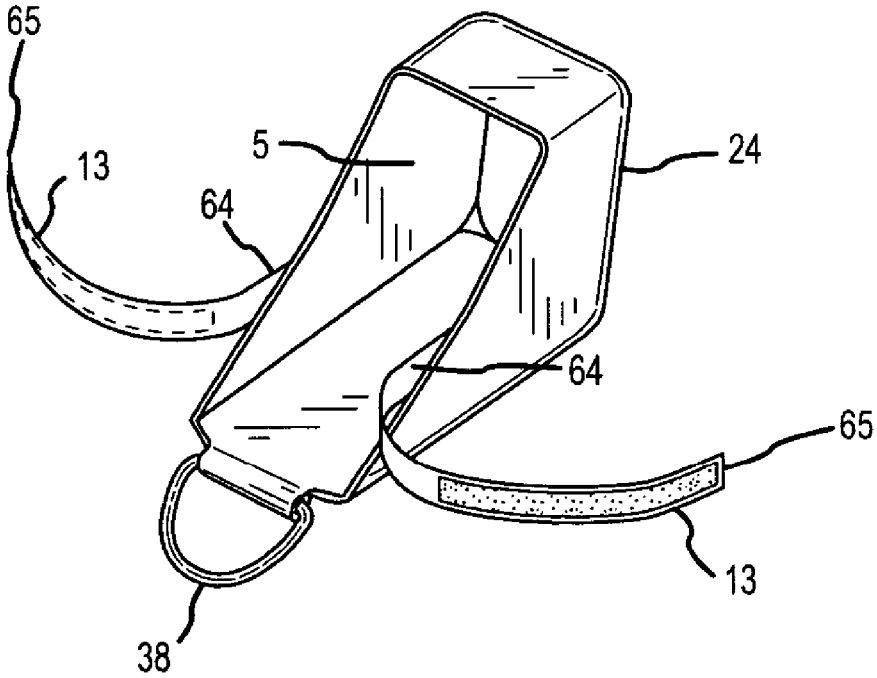
FIG. 29 is a perspective view of a particular embodiment of a tool containment invention shown in FIG. 28 disengaged from the external surface of a tool.

As to other embodiments of the invention as shown primarily by FIGS. 26-31, the flexible member (13) can be joined to a boot (24) having a pre-formed configuration which engages all or part of the external surface of the power source (4) of the tool, such as the battery elements shown by FIGS. 24 and 26; however, by providing the pre-formed configuration of the boot (24), the boot (24) need not be operably configured (26), as above-described. The pre-formed configuration of certain embodiments of the boot (24) can be formed or molded utilizing processes such as vacuum forming or injection molding with suitable formable or moldable materials including without limitation plastics such as styrene, acrylonitrile butadiene styrene, Kydex®, polyvinyl chloride, or the like. As shown by FIGS. 28 and 29, as to certain embodiments of the invention which include a boot (24) the flexible member (13) can be joined to the boot (24) as pair of flexible members (13)(although a single flexible member (13) could also be utilized that joins a center portion of the flexible member (13) to the boot, as shown by FIG. 27) each of the pair of flexible members (13) joined by a corresponding one each flexible member end (64) allowing each of the opposed member ends (65) to further include the releasably secureable mated parts (22)(23) of the securement element (21).

Also while FIGS. 24, 26, and 28 show a particular configuration of the power source (4), engaged by the boot (24), such as the removable battery element shown, it is not intended that the power source (4) be limited to the configurations shown. Rather, it is intended that one or a plurality of configuration(s) of the boot (24) can be pre-formed each of which engage a part of the external surface of one or all of the numerous and wide variety of power sources (4) available regardless of the external surface configuration.

Figure 30:
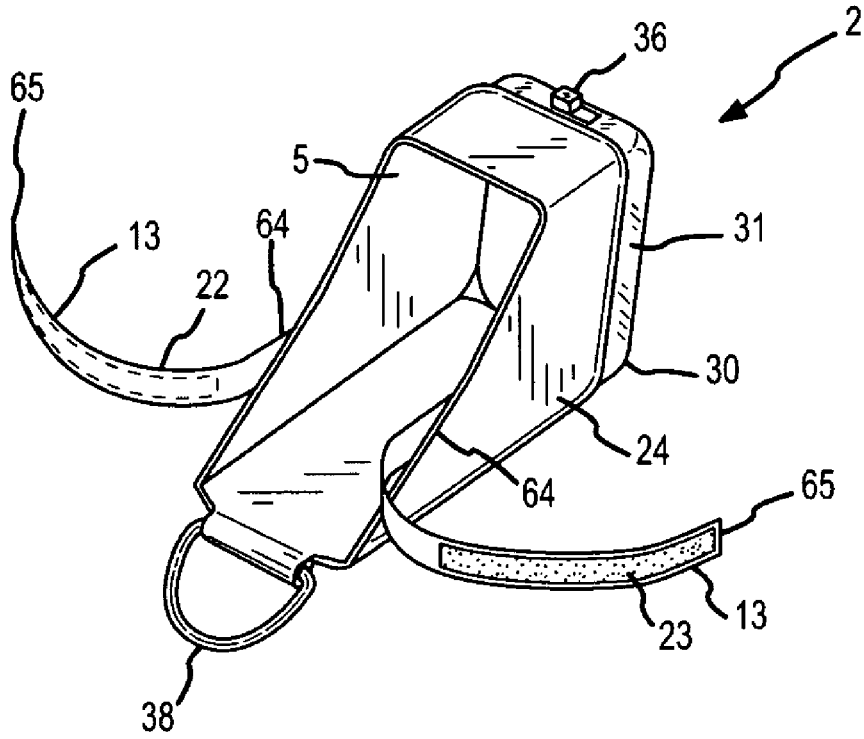
FIG. 30 is a perspective view of a particular embodiment of a tool containment invention further including an illumination assembly.
Figure 31:
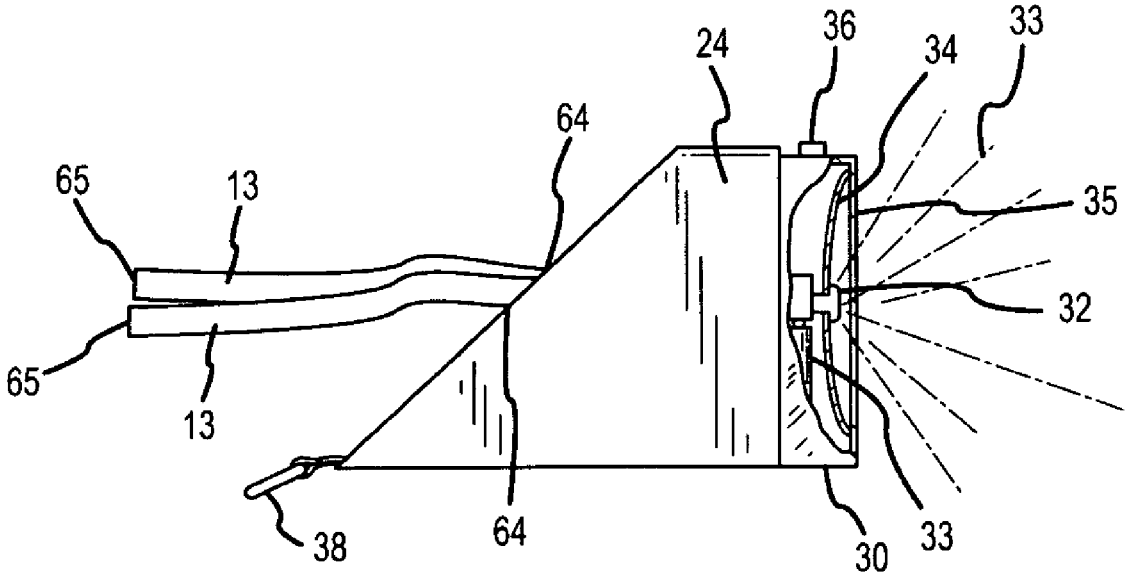
FIG. 31 is a side view of a particular embodiment of a tool containment invention shown in FIG. 30 with a portion of the illumination assembly cut away to show a portion of the interior of the main body.
Figure 32:
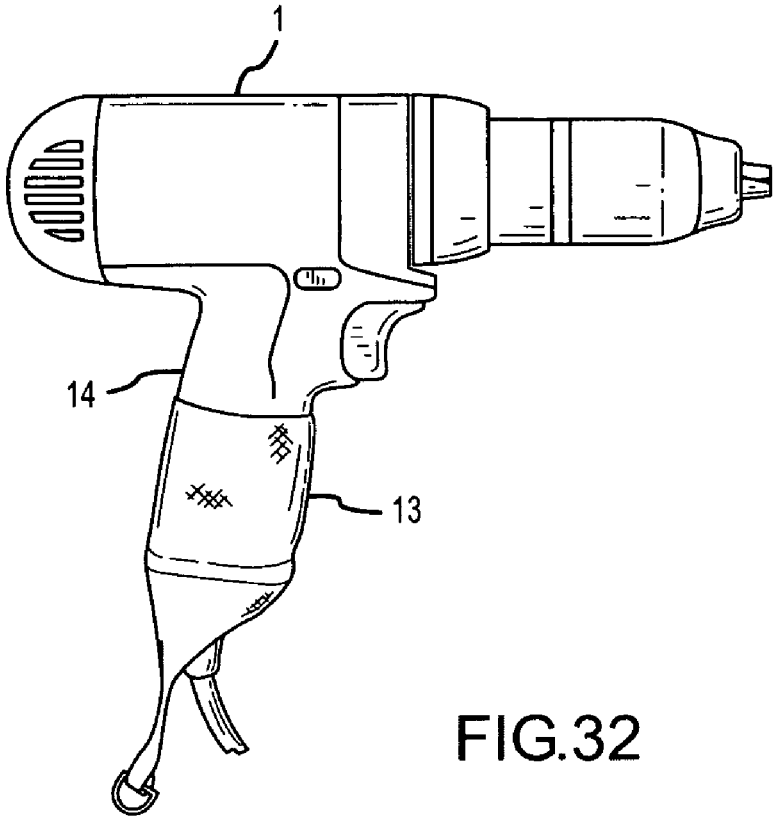
FIG. 32 is a side view a particular embodiment of a tool containment invention having flexible member which engages a part of the external surface of a tool.
Figure 33:
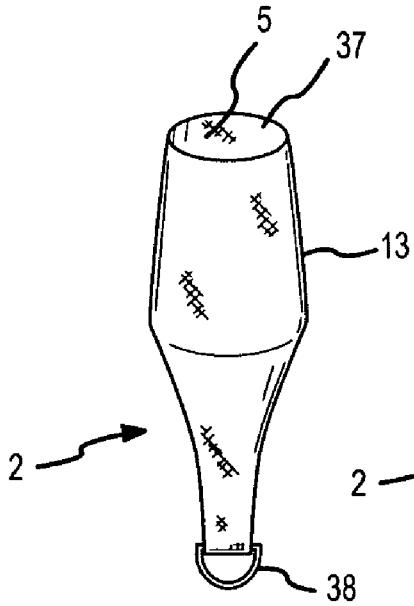
FIG. 33 is a end view of a particular embodiment of the tool containment invention shown by FIG. 32 disengaged from the external surface of a tool.
Figure 34:
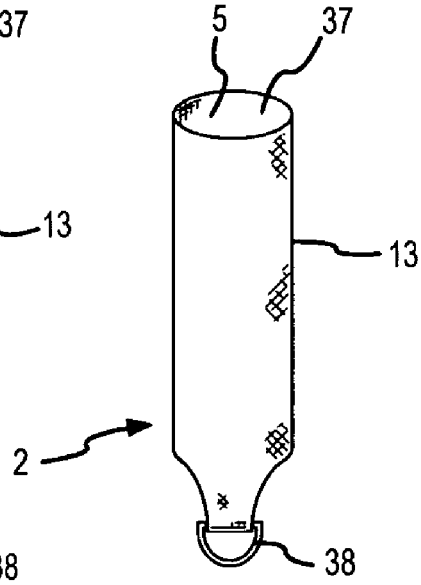
FIG. 34 is a end view of a particular embodiment of the tool containment invention shown by FIG. 32 disengaged from the external surface of a tool.
Figure 35:
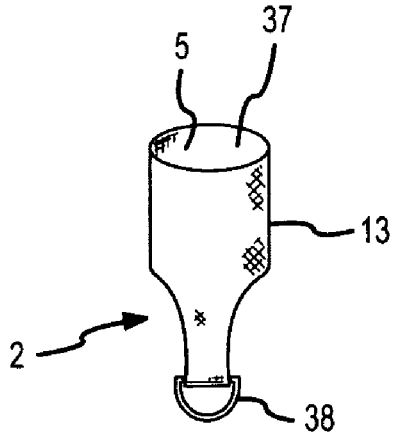
FIG. 35 is a end view of a particular embodiment of the tool containment invention shown by FIG. 32 disengaged from the external surface of a tool.

Now referring primarily to FIGS. 30 and 31, an illumination assembly (30) can be coupled to the boot (24). The illumination assembly (30) can include a main body (31) which contains one, a pair, or a plurality of light emission source(s) (32)(see cut away view shown by FIG. 21) responsive to a power source (33) the current from which can be interrupted by operation of a switch (36). As to certain embodiments of the invention, the light emission source (32) can be a light emitting diode.

TABLE 1

| Material | Formula | Energy Gap | Wavelength |
|---|---|---|---|
| Gallium Phosphide | GaP | 2.24 eV | 550 nm |
| Aluminum Arsenide | AlAs | 2.09 eV | 590 nm |
| Gallium Arsenide | GaAs | 1.42 eV | 870 nm |
| Indium Phosphide | InP | 1.33 eV | 930 nm |
| Aluminum-Gallium Arsenide | AlGaAs | 1.42-1.61 eV | 770-870 nm |
| Indium-Gallium-Arsenide-Phosphide | InGaAsP | 0.74-1.13 eV | 1100-1670 nm |

Table 1 lists certain light emitter materials, the emission wavelength and corresponding energy gap. The first materials, GaP and AlAs, can be used to make light emission sources (32) which provide emitted light (33) in the visible portions of the spectrum. A particular embodiment of the light emission source (32) can be a Luxeon® brand (32) by Lumileds® which can be operated with an illumination power source (33) including a 1.7 V lithium battery to generate emitted light (33). However, it is not intended that the light emission source (32) be limited to a light emitting diode which can be selected from various types of light emission sources (32) such incandescent lamps, or the like. The illumination power source (33) can be configured to provide three AAA batteries or alternately can be configured to provide a wide variety of battery configurations such as: AA, ½ AA, wafer cell, pin barrel, or the like.

Now referring primarily to FIG. 31, the illumination assembly (30) can further provide a reflector (34) which reflects emitted light (33) through a lens (35). The reflector (34) can further provide an arcuate surface to adjust illuminance distribution over the entire surface of the lens (35). The configuration of the reflector (34) can be based on curves such as a parabola, semicircle, or cusp, or a combination thereof All of these curves can provide arcuate reflector surfaces which provide satisfactorily uniform illuminance distribution of emitted light (33) on the surface of the lens (35), if the configuration of illumination source (32), the interior configuration of the main body (31) and the configuration of the reflector (34) are properly chosen.

Now referring primarily to FIGS. 32-35, certain embodiments of the tool containment system provide a one piece flexible member (13) having a hollow interior space (37) defined by disposition of the first flexible member surface (5) a part of which engages a part of the external surface of the tool (1), such as the handle (14) of the drill motor shown by FIG. 25. The one piece flexible member (13) can be generated for example by weaving fibers with a circular loom or can be generated by seaming opposed ends of a substantially planar material. Regardless of the approach to generating the one piece flexible member (13), the one piece flexible member (13) must operate to receive a part of the external surface of the tool (1) in the hollow space (37) and sufficiently engage such part of the external surface of the tool (1) to oppose forces during operation of the tool (1) including forces involved in dropping the tool or generated by tethering the tool as above-described. Sufficient engagement of the element engagement surface (5) can be generated by a weave which responds to such forces by reducing the volume of the hollow space (37) upon receiving such forces, or can be generated by incorporating a resiliently flexible fiber into the weave of the one piece flexible member (13), or both.

Again referring generally to FIGS. 1-37, a tether securement element (38) can be coupled to the flexible member (13). As to certain embodiments of the invention, the tether securement element (38) can comprise a D ring as shown for example by FIGS. 2 and 3. Alternately as shown for example by FIGS. 4-6, the tether securement element (38) can comprise a plastic flange having a flange aperture (66) coupled to the flexible member (13). Or can be an flexible member aperture (67) established in a portion of the flexible member (13) as shown for example by FIG. 11 (showing a slot established in a portion of the flexible member (13)); however, these examples are not intended to limit the wide variety of tether securement elements (38) which can be coupled to the flexible member (13) such as a ring, mechanical hardware including a threaded surface, a U ring, triangular ring, or the like.

Now referring primarily to FIGS. 15 and 16, the invention can further include a pocket element (39) configured to provide at least one pocket space (40) in which objects can be located. The pocket element (39) can be configured to receive objects such as drills, blades, drivers, bits, nails, screws, staples, rivets, or the like. As such, the pocket element (39) can be configured as a plurality of pockets as shown by FIGS. 15 and 16, or can be configured as a single pocket, or otherwise depending upon the application of the tool containment system.

Now referring primarily to FIG. 24, the invention can further include an object retention element (41) which can be coupled at a location on the flexible member (13) or the flexible member (13) to provide a surface capable of retaining objects such as drills, blades, drivers, bits, nails, screws, staples, rivets, or the like. As to certain embodiments of the invention, the object retention element (41) can provide a magnetic surface, an adhesive surface, or other type of surface capable of retaining the desired object during operation of the tool (1).

Figure 36:
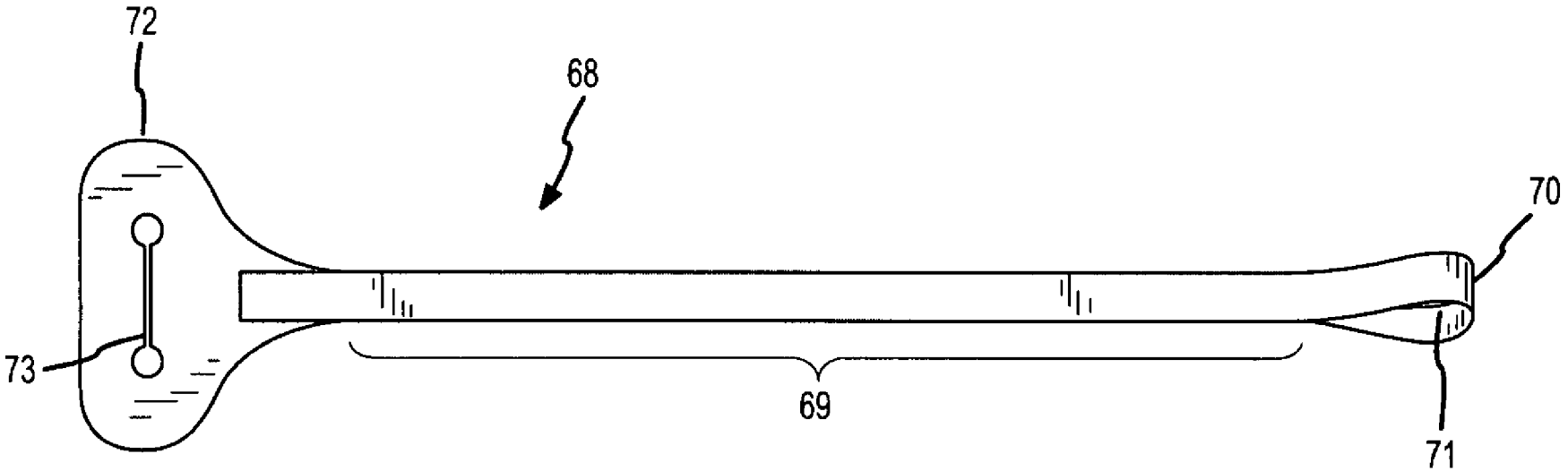
FIG. 36 is a plan view of a particular embodiment of a power conduit leash.
Figure 37:
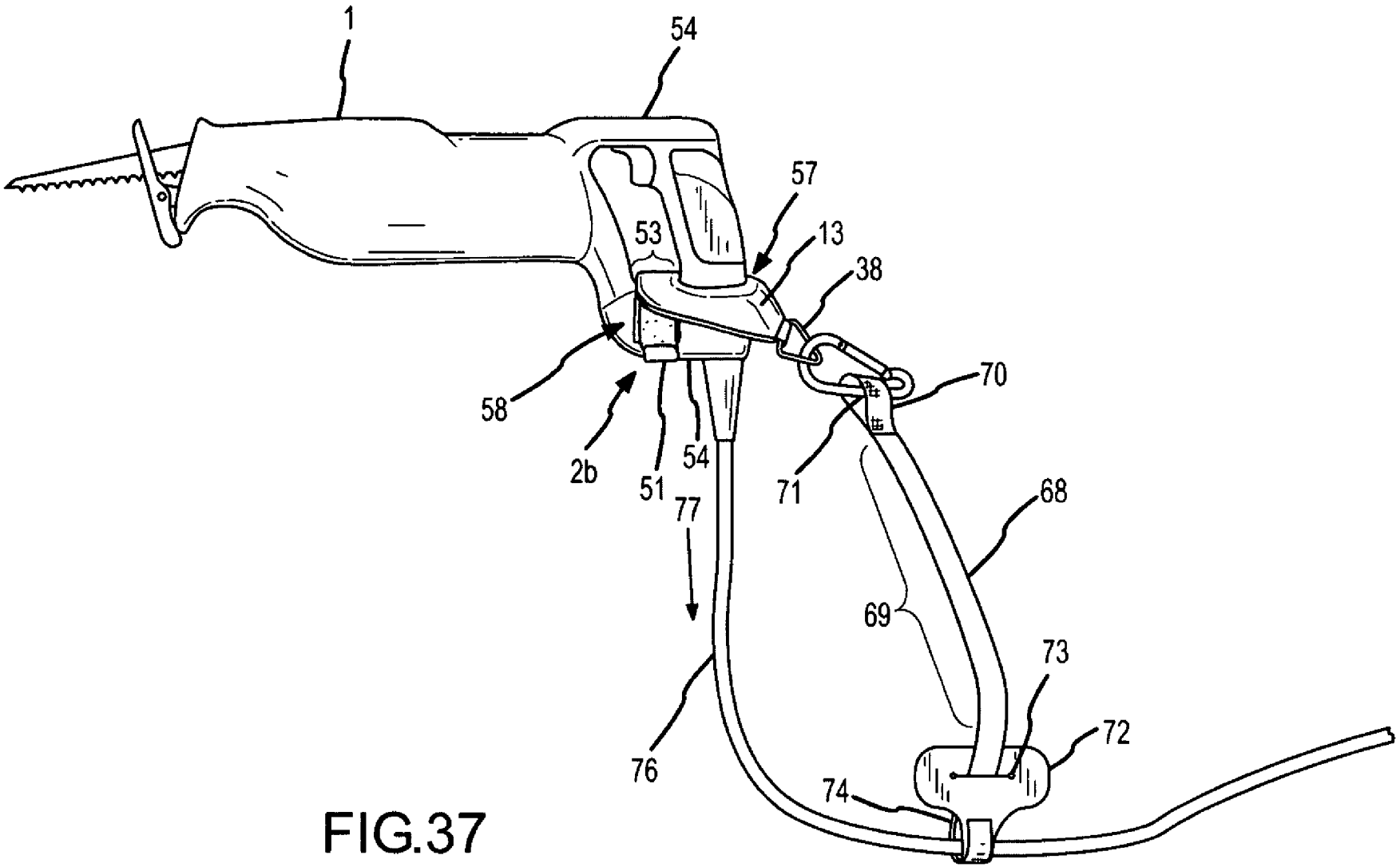
FIG. 37 is a side view of the particular embodiment of the power conduit leash shown in FIG. 36 coupled between the tether securement element of the tool containment invention and a power conduit.

Now referring primarily to FIGS. 36 and 37, the invention can further include a power conduit leash (68) having an elongate flexible center portion (69) coupled to a first leash end (70) and a second leash end (72). The first leash end (70) can provide first leash end connection means (71), such as the first loop element shown by FIGS. 36 and 37. The second leash end (72) can provide a second terminal end aperture (73) through which the first leash end (70) can travel to allow formation of a second loop element (74)(as shown in FIG. 37). The second loop element (74) can be formed about a power conduit (76) and the first leash end (70) can be secured by the first leash connection means (71) to the various embodiments of the tether securement element (38) coupled to the flexible member (13), above-described. By forming the second loop element (73) about the power conduit (75) (which can be any manner of power conduit including for example an electrical conductor, such as insulated wire, an air conductor, such as a pneumatic hose, or the like, regardless of configuration or manner of coupling to the tool (1)) and securing the first leash end (70) to the tether securement element (38) by the first leash connection means (71), the coupling between the tool (1) and the power conduit (75) can be maintained in the engaged condition even when the power conduit (75) transmits forces which would other wise disengage the tool (1) from the power conduit (75), or if the power conduit does disengage from the tool (1) the power conduit leash (76) can limit travel of the power conduit (76) away from the tool (1). The transmitted forces can be an amount of pressure within the power conduit (76) (such as an amount of air pressure within a pneumatic hose) greater than the atmospheric pressure acting upon the external surface of the power conduit (76), or can be a sufficient amount of force (77) which acts on the power conduit (76) to generate travel in the power conduit (76) sufficient to disengage the power conduit from the tool (1).

As can be easily understood from the foregoing, the basic concepts of the present invention may be embodied in a variety of ways. The invention involves numerous and varied embodiments of a tool containment system and methods of making and using such tool containment system.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "securement" should be understood to encompass disclosure of the act of "securing"—whether explicitly discussed or not—and, conversely, were there effectively disclosure of the act of "securing", such a disclosure should be understood to encompass disclosure of a "securement" and even a "means for securing." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the tool containment systems or flexible members herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth below are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below, if any, are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A tool containment device, comprising:

a) a tool having a handle extending from a battery enclosure;

b) a flexible member having a planar condition in which an aperture communicates between opposed surfaces, said aperture having a perimeter with an opening through which said tool handle passes;

c) a first securement element includes a pair of releasably securable mated parts one each coupled to opposed surfaces of said flexible member which engage to close said opening in said perimeter of said aperture to annularly engage said tool handle;

d) at least one elongate flexible member connected to said flexible member which upon closure of said opening in said perimeter annularly engages said battery enclosure in substantially perpendicular relation to said flexible member; and e) a second securement element including a second pair of releasably securable mated parts one each coupled to opposed surfaces of said at least one elongate flexible member each at a location which upon engagement conforms said flexible member to said tool.

2. The tool containment device as described in claim 1, further comprising a tether securement element coupled to said flexible member.

3. The tool containment device as described in claim 2, wherein said tether securement element comprises at least one ring securable to a tether.

* * * * *